US010968715B2

(12) United States Patent
McDaniel et al.

(10) Patent No.: US 10,968,715 B2
(45) Date of Patent: Apr. 6, 2021

(54) SYSTEMS FOR SEALING PRESSURE CONTROL EQUIPMENT

(71) Applicant: Cameron International Corporation, Houston, TX (US)

(72) Inventors: Ian McDaniel, Houston, TX (US); Jesse Garcia, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 71 days.

(21) Appl. No.: 16/243,068

(22) Filed: Jan. 8, 2019

(65) Prior Publication Data

US 2020/0217163 A1 Jul. 9, 2020

(51) Int. Cl.

| | |
|---|---|
| ***E21B 33/03*** | (2006.01) |
| ***E21B 47/06*** | (2012.01) |
| *E21B 19/10* | (2006.01) |

(52) U.S. Cl.

CPC ..... *E21B 33/03* (2013.01); *E21B 47/06* (2013.01); *E21B 19/10* (2013.01)

(58) Field of Classification Search

CPC ..... E21B 33/03; E21B 33/02; E21B 33/0355

See application file for complete search history.

(56) References Cited

U.S. PATENT DOCUMENTS

| | | | | |
|---|---|---|---|---|
| 3,577,737 | A * | 5/1971 | Burleson | E02B 17/0013 405/227 |
| 6,105,939 | A | 8/2000 | Vance et al. | |
| 6,192,981 | B1 * | 2/2001 | Boquet | E21B 19/10 166/75.13 |
| 6,305,471 | B1 | 10/2001 | Milloy | |
| 6,543,780 | B1 * | 4/2003 | Kogler | F16L 5/02 138/89 |
| 8,443,878 | B2 | 5/2013 | McCollin | |
| 9,376,887 | B2 | 6/2016 | Bernard et al. | |
| 9,784,720 | B2 * | 10/2017 | Zeko | G01N 30/6004 |
| 2002/0139535 | A1 * | 10/2002 | Nice | E21B 33/076 166/344 |
| 2010/0314099 | A1 | 12/2010 | Fogg et al. | |
| 2015/0075774 | A1 * | 3/2015 | Raggio | E21B 33/129 166/135 |
| 2020/0088337 | A1 * | 3/2020 | Gagne | A61M 5/14 |

FOREIGN PATENT DOCUMENTS

EP 1792046 A1 3/2006

* cited by examiner

*Primary Examiner* — Kenneth L Thompson

(57) ABSTRACT

An actuation assembly to actuate a component of a mineral extraction system, where the actuation assembly includes an actuator configured to generate a force in a direction, a lever assembly coupled to the actuator, where the lever assembly is configured to rotate about a fulcrum in response to application of the force, and a piston coupled to the lever assembly, where the piston is configured to move in the direction in response to rotation of the lever assembly about the fulcrum.

17 Claims, 14 Drawing Sheets

SYSTEMS FOR SEALING PRESSURE CONTROL EQUIPMENT

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Such systems generally include a wellhead assembly through which the resource is extracted. At various times, operations may be carried out to inspect or to service the well, for example. During these operations, pressure control equipment is mounted above the wellhead to protect other surface equipment from surges in pressure within the wellbore or to carry out other supportive functions.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
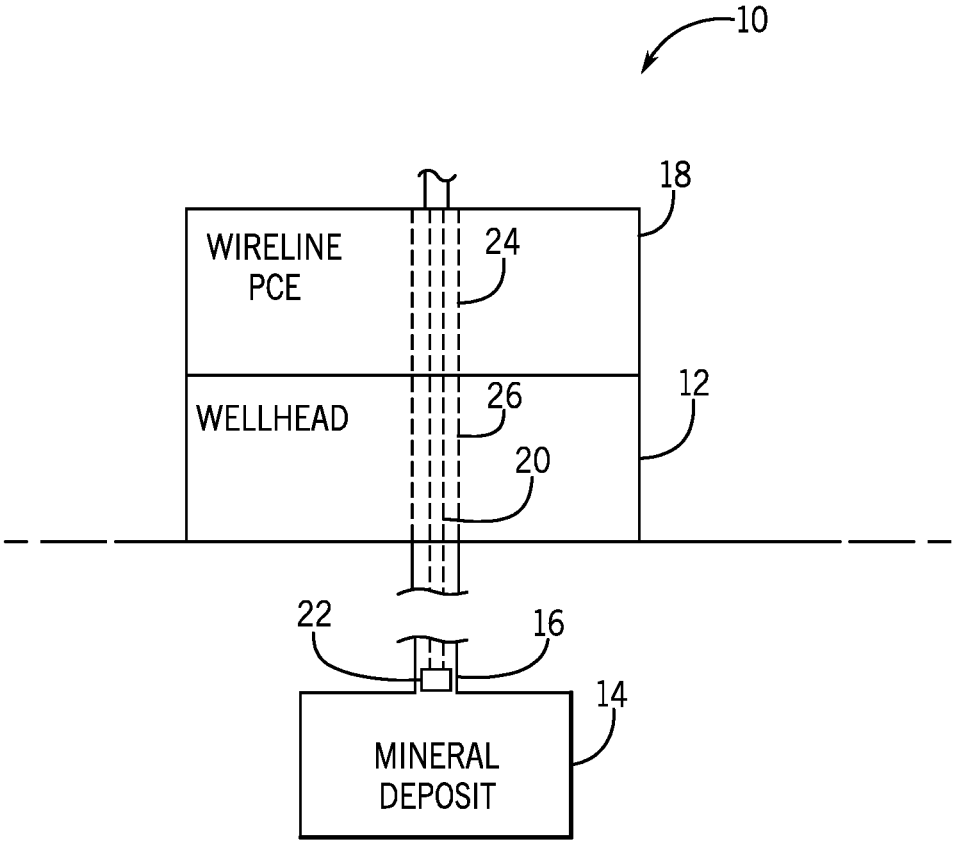
FIG. 1 is a schematic diagram of an embodiment of a mineral extraction system having a pressure control equipment (PCE) stack.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments generally relate to pressure control equipment (PCE) systems and methods. PCE stacks are coupled to and/or positioned vertically above a wellhead during various intervention operations, such as wireline operations in which a tool supported on a wireline is lowered through the PCE stack to enable inspection and/or maintenance of a well, for example. The PCE stack includes components that seal about the wireline or other conduit as it moves relative to the PCE stack. The PCE stack may isolate the environment, as well as other surface equipment, from pressurized fluid within the well. In the present disclosure, a conduit may be any of a variety of tubular or cylindrical structures, such as a wireline, Streamline™, slickline, coiled tubing, or other spoolable rod.

With some existing PCE stacks, an operator may provide manual inputs to control a hydraulic actuator to adjust components of the PCE stack. However, such existing PCE stacks may be large, imprecise, inefficient, and/or expensive to operate due to the use of hydraulic actuators and/or due to involvement of the operator, for example. Accordingly, the present embodiments include an actuator (e.g., an electric actuator) coupled to a lever assembly that drives a piston to form the seal about the conduit. For example, the actuator may transfer a linear force to a first end of the lever assembly, which may then rotate about a fulcrum positioned at a second end of the lever assembly, opposite the first end. The lever assembly is coupled to the piston via a rod or pin positioned between the first end of the lever assembly and the second end of the lever assembly. As such, the lever assembly may act as a class two lever that may increase an amount of force applied by the lever assembly to the piston. In some embodiments, the lever assembly is configured to transfer a force to the piston that is greater than a force generated by the actuator. In any case, the force applied to the piston by the lever assembly compresses a packer (e.g., an elastomeric packer) and causes the packer to seal around the conduit. Additionally or alternatively, the actuator and lever assembly may be utilized to control or adjust a position of other components within the PCE stack (e.g., a tool catcher and/or a tool trap).

With the foregoing in mind, FIG. 1 is a schematic diagram of an embodiment of a system 10 (e.g., mineral extraction system). The system 10 includes a wellhead 12, which is coupled to a mineral deposit 14 via a wellbore 16. The wellhead 12 may include any of a variety of other components such as a spool, a hanger, and a "Christmas" tree. In the illustrated embodiment, a pressure control equipment (PCE) stack 18 is coupled to the wellhead 12 to facilitate intervention operations, which may be carried out by lowering a conduit 20 (e.g., communication conduit, wireline, slickline, spoolable rod, or coiled tubing) and/or a tool 22 (e.g., configured to collect data about the mineral deposit 14 and/or the wellbore 16) through a bore 24 defined by the PCE stack 18, through a bore 26 defined by the wellhead 12, and into the wellbore 16. As discussed in more detail below, the PCE stack 18 may include a packer (e.g., an elastomeric packer) that seals about the conduit 20 to isolate the environment, as well as other surface equipment, from pressurized fluid within the wellbore 16.

Figure 2:
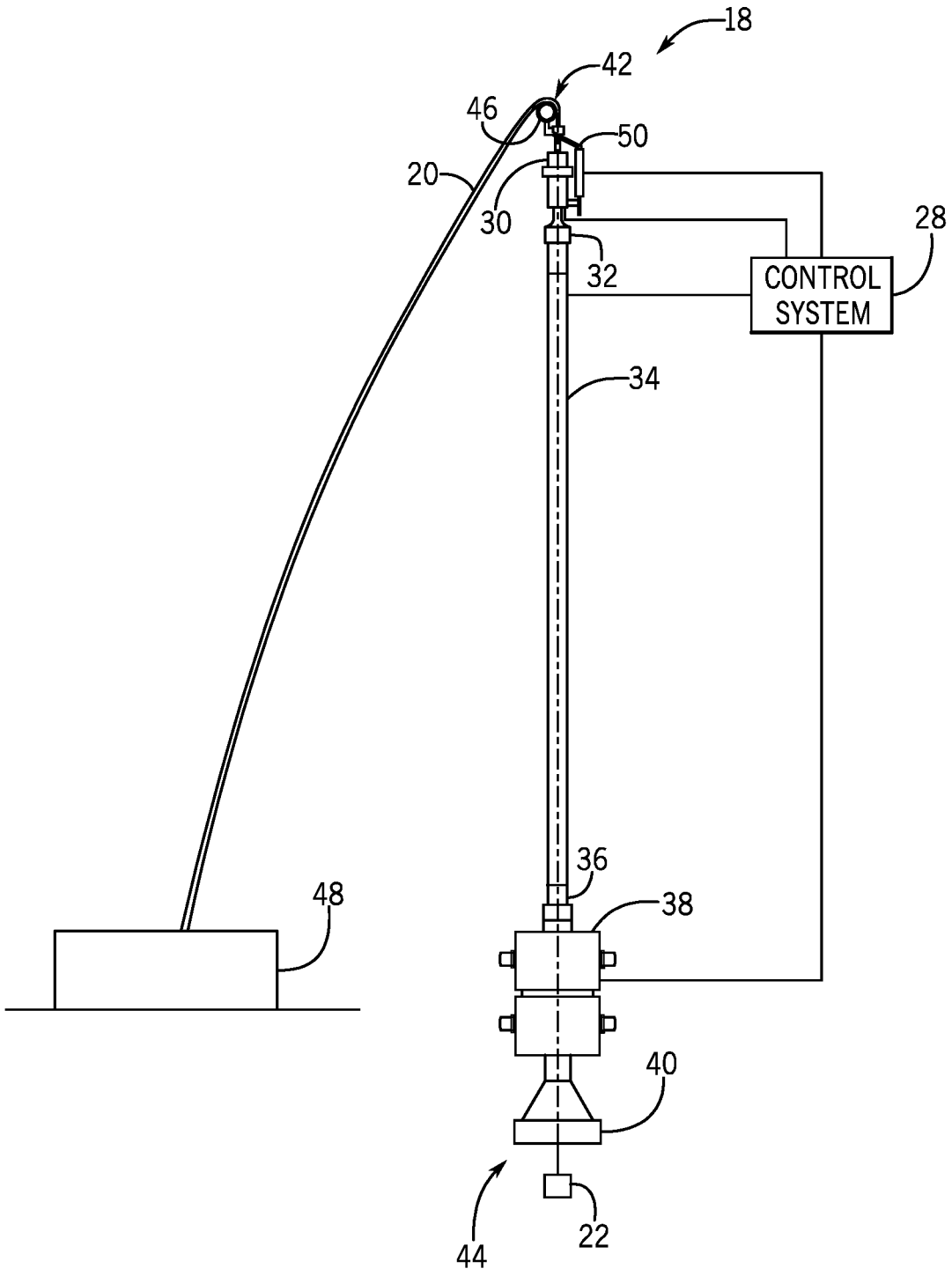
FIG. 2 is a side view of an embodiment of the PCE stack of FIG. 1.

FIG. 2 is a side view of an embodiment of the PCE stack 18 that may be used in the system 10 of FIG. 1. The PCE stack 18 may include one or more components that enable the PCE stack 18 to seal about the conduit 20. Thus, the PCE stack 18 may isolate the environment, as well as other surface equipment, from pressurized fluid within the wellbore 16.

In the illustrated embodiment, the PCE stack 18 includes a stuffing box 30, a tool catcher 32, a lubricator section 34, a tool trap 36, a valve stack 38, and a connector 40 to couple the PCE stack 18 to the wellhead 12 or other structure. These components are annular structures stacked vertically with respect to one another (e.g., coaxial) to enable the conduit 20 to extend through the PCE stack 18 (e.g., from a first end 42 to a second end 44 of the PCE stack 18) into the wellhead 12. As shown, the conduit 20 extends from the first end 42 of the PCE stack 18 and over a sheave 46 to a winch 48, and rotation of the winch 48 (e.g., a drum or spool of the winch 48) raises and lowers the conduit 20 with the tool 22 through the PCE stack 18. It should be appreciated that the PCE stack 18 may include various other components (e.g., cable tractoring wheels to pull the conduit 20 through the stuffing box 30, a pump-in sub to enable fluid injection).

In the illustrated PCE stack 18, the stuffing box 30 is configured to seal against the conduit 20 (e.g., to seal an annular space about the conduit 20) to block a flow of fluid from the bore 24 vertically above the stuffing box 30. In the illustrated embodiment, the stuffing box 30 includes a housing supporting a packer (e.g., elastomeric packer), which may be an annular packing material or other compressible annular structure that forms a seal against the conduit 20. In some embodiments, movement of an actuation assembly 50 adjusts a compressive force (e.g., in a vertical direction) on the packer to adjust the seal against the conduit 20. For example, movement of the actuation assembly 50 may squeeze the packer vertically, thereby driving the packer radially (e.g., toward the conduit 20) to increase a surface area and/or an effectiveness of the seal against the conduit 20.

The tool catcher 32 is configured to engage or catch the tool 22 to block the tool 22 from being withdrawn vertically above the tool catcher 32 and/or to block the tool 22 from falling vertically into the wellbore 16. The lubricator section 34 may include one or more annular pipes joined to one another, and the lubricator section 34 may support or surround the tool 22 while it is withdrawn from the wellbore 16. The tool trap 36 is configured to block the tool 22 from falling vertically into the wellbore 16 while the tool trap 36 is in a closed position.

As set forth above, actuators that are utilized to control various components of the PCE stack 18 may increase a size or footprint of the PCE stack 18, reduce an efficiency of the PCE stack 18, and/or increase operating costs of the PCE stack 18. Further, existing actuators (e.g., hydraulic actuators) may not include enough precision to enable a control system to automate actuation of components of the PCE stack 18. As such, embodiments of the present disclosure are directed to an actuation assembly that includes an actuator (e.g., a linear actuator, an electric actuator, and/or another suitable actuator), a lever assembly, and a piston. The actuation assembly increases an amount of force applied by the piston on the packer that is configured to seal around the conduit 20 passing through the PCE stack 18. Accordingly, a size of the actuator utilized to ultimately drive movement of the piston may be reduced as a result of the increased amount of force applied by the actuation assembly. Further, control of the actuation assembly may have enhanced precision, thereby enabling a feedback control loop to be formed for automated control over various components of the PCE stack 18. Further still, the actuation assembly may reduce a size of the PCE stack 18 by eliminating hydraulic pumps, tanks, accumulators, valves, and/or other components of the PCE stack 18.

Figure 3:
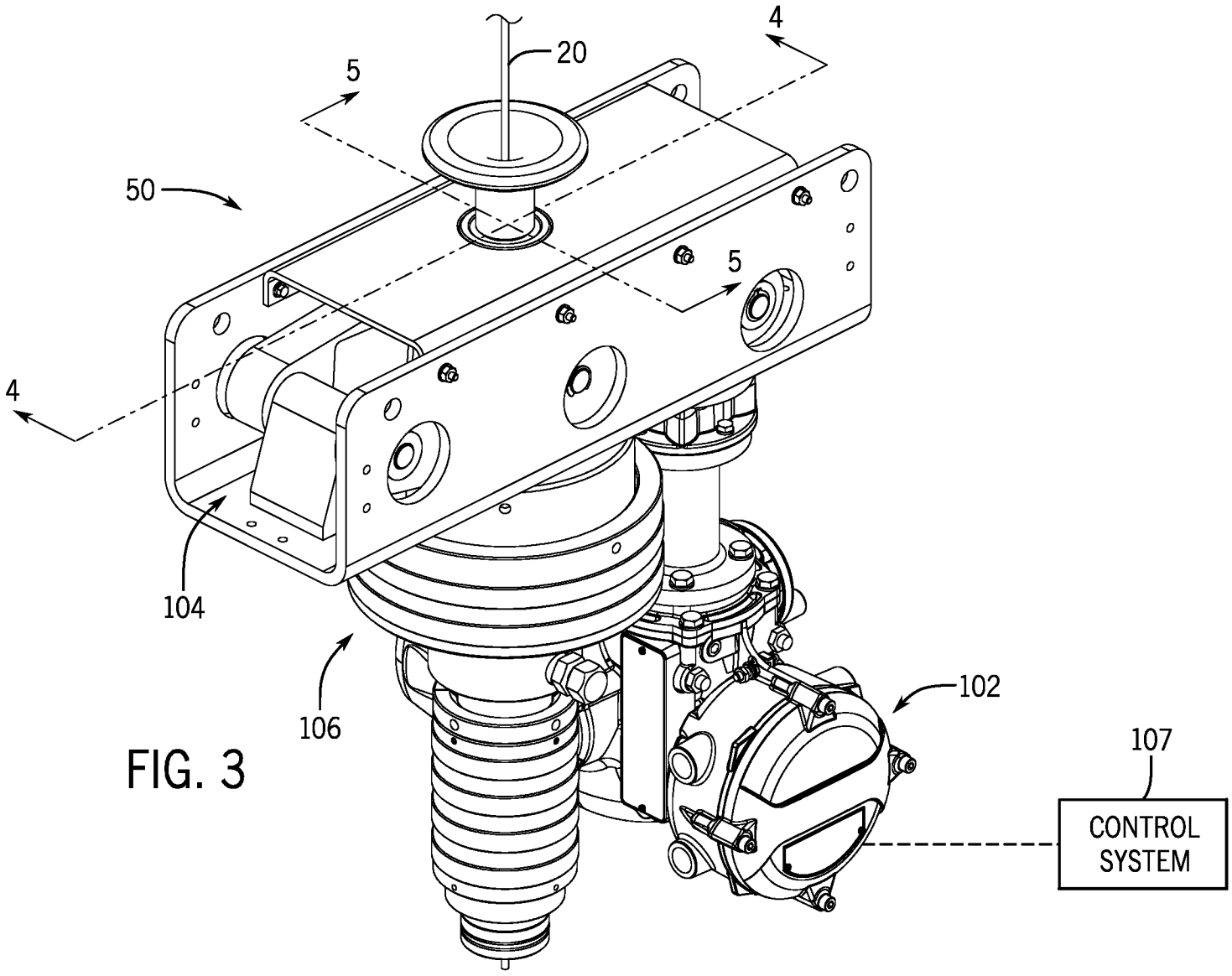
FIG. 3 is a perspective view of an embodiment of an actuation assembly for a component of the PCE stack.

For example, FIG. 3 is a perspective view of an actuation assembly 50 (e.g., an actuation assembly for the stuffing box 30) of the PCE stack 18 that may be utilized to form a seal around the conduit 20. The actuation assembly 50 includes an actuator 102 (e.g., an electric, linear actuator), a lever assembly 104, and a piston assembly 106. As will be described in detail herein with reference to FIGS. 4-7, the actuator 102 may generate a force that is applied to the lever assembly 104. The lever assembly 104 may rotate and transfer the force to the piston assembly 106, which is configured to contact and compresses a packer to seal around the conduit 20.

In some embodiments, the actuator 102 is communicatively coupled to a control system 107 (e.g., the control system 28 and/or another electronic control system), such as a control system of the PCE stack 18. The control system 107 may be configured to receive feedback from one or more sensors of the system 10 and/or the PCE stack 18 and send signals to control or actuate components of the PCE stack 18. For instance, the control system 107 may receive feedback from a sensor (e.g., a pressure sensor or a pressure transducer) indicative of a pressure within the wellbore 16. When the pressure within the wellbore 16 reaches a threshold level, the control system 107 may send a signal to the actuator 102 to form the seal about the conduit 20. In some embodiments, the actuator is an electric, linear actuator configured to generate a force applied to the lever assembly 104 (e.g., 100 pounds-force or 444 Newtons). In some embodiments, the control system 107 may control the actuator 102 to form the seal about the conduit 20 based on feedback indicative of a pressure in another suitable location (e.g., in the lubricating section 34 or in the wellhead 12). In any case, the actuation assembly 50 may be controlled to block fluid from inadvertently flowing from the wellbore 14 toward a surface or other environment.

Figure 4:
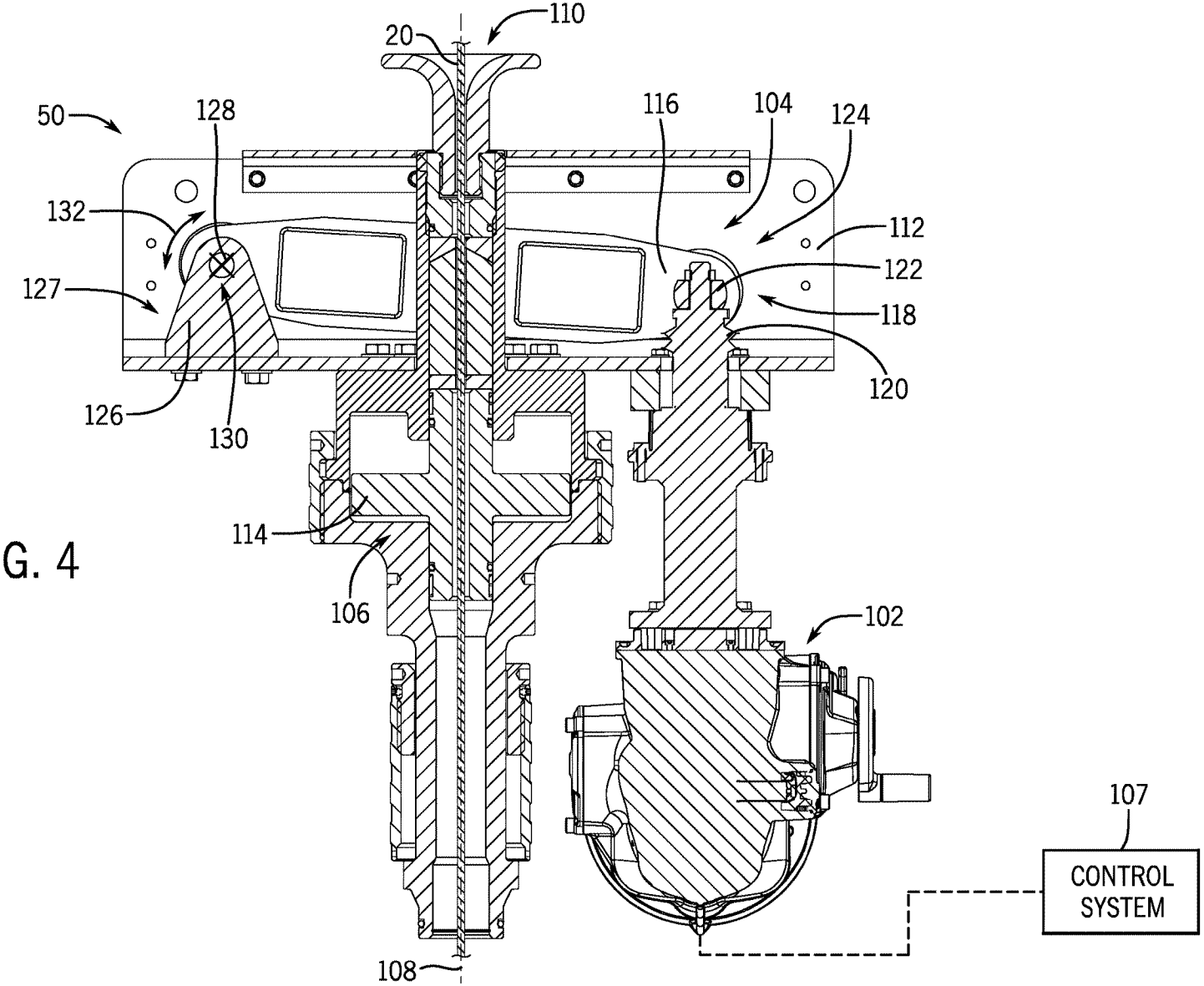
FIG. 4 is a front cross-section of an embodiment of the actuation assembly of FIG. 3 in an open position.

FIG. 4 is front cross section of an embodiment of the actuation assembly 50 in an open position (e.g., a seal is not formed around the conduit 20) taken along line 4-4 of FIG. 3. As shown in the illustrated embodiment of FIG. 4, the actuation assembly 50 includes the actuator 102 configured to generate a force along an axis 108 (e.g., central axis) defining a passage 110 (e.g., an annular passage) through which the conduit 20 extends. The actuator 102 is coupled to a housing 112 of the actuation assembly 50 (e.g., via one or more fasteners, such as bolts). In some embodiments, the housing 112 of the actuation assembly 50 encloses the lever assembly 104 that is configured to transfer the force generated by the actuator 102 to a piston 114 (e.g., annular piston) of the piston assembly 106. A lever 116 (e.g., a first lever) of the lever assembly 104 is coupled to the actuator 102, such as via an interface 118 having a rod 120 and a fastener 122 (e.g., a coupler having a nut or a bar having a nut) coupling the rod 120 to the lever 116. The lever 116 may be coupled to the actuator 102 (e.g., via the rod 120 and the fastener 122) at a first end 124 of the lever 116. Additionally, the lever 116 may be coupled (e.g., rotatably coupled, such as via a pin) to a fulcrum 126 at a second end 127 of the lever 116, opposite the first end 124. The fulcrum 126 may be stationary relative to the housing 112, and the fulcrum 126 may be a separate piece that is coupled to the housing 112 (e.g., via one or more fasteners, such as bolts) or may be integrally formed with the housing 112 (e.g., welded to or formed as a single, unitary piece). The fulcrum 126 may enable the lever 116 to rotate about an axis 128 defined by a junction 130 between the lever 116 and the fulcrum 126. As the actuator 102 applies the force along the axis 108, the lever 116 rotates about the axis 128 in a circumferential direction 132 to move the piston 114.

Figure 5:
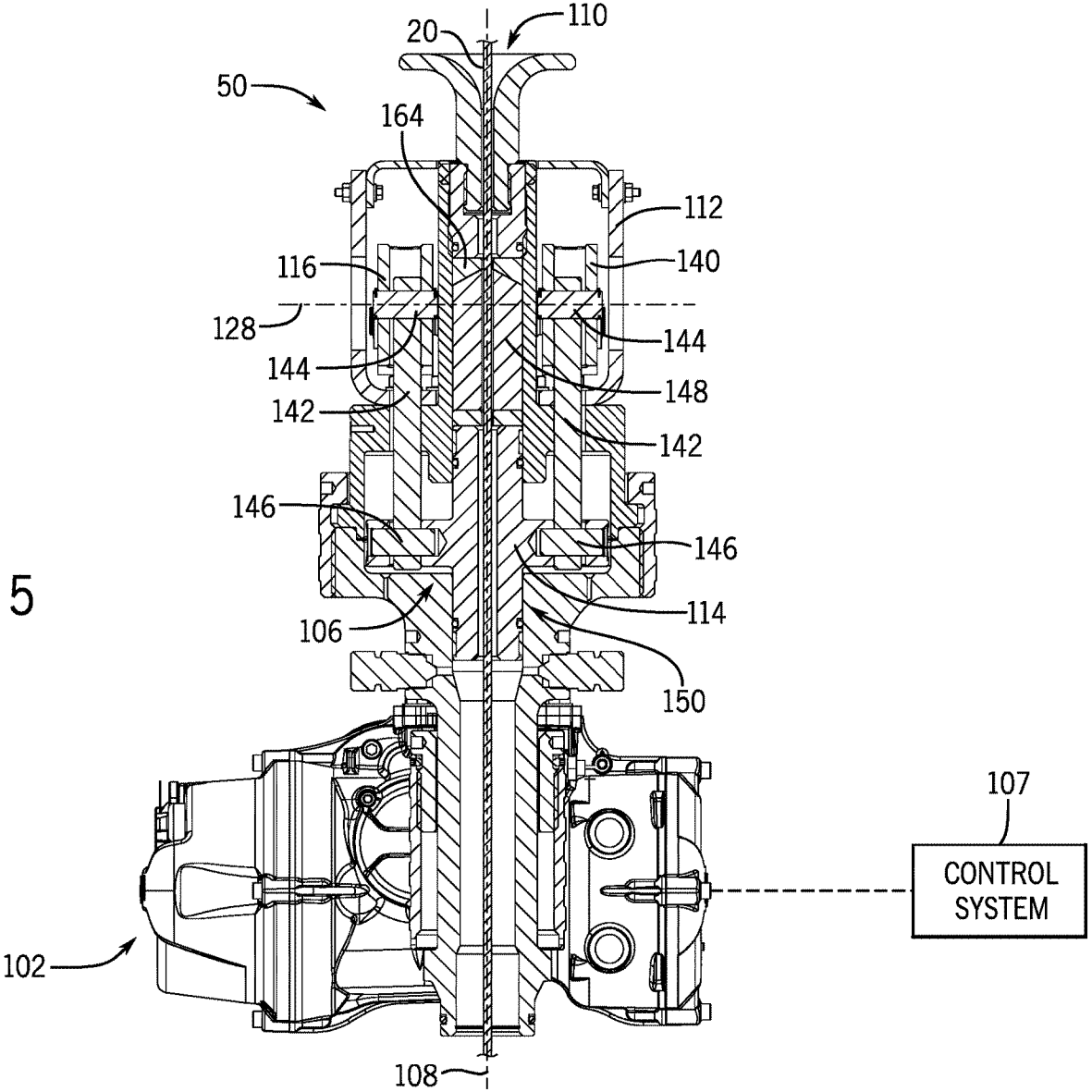
FIG. 5 is a side cross-section of an embodiment of the actuation assembly of FIG. 3 in the open position.

For example, FIG. 5 is a side cross section of an embodiment of the actuation assembly 50 in the open position taken along line 5-5 of FIG. 3. As shown in the illustrated embodiment of FIG. 5, the piston 114 is coupled to the lever 116 and an additional lever 140 (e.g., a second lever) of the lever assembly 104 via rods 142. While the illustrated embodiment of FIG. 5 shows the lever assembly 104 having two levers 116, 140, the lever assembly 104 may include one lever, three levers, four levers, five levers, or more than five levers. Further still, in some embodiments, the levers 116, 140 may be balanced with one another, such that movement of the levers 116, 140 is substantially synchronized with one another. In some embodiments, the levers 116, 140 may be unbalanced or otherwise able to move independently of one another. The rods 142 may generally be coupled to the levers 116, 140 via one or more fasteners 144 (e.g., bolts, screws, rods, pins, rivets, brackets, or a combination thereof) and to the piston 114 via one or more fasteners 146 (e.g., bolts, screws, rods, pins, rivets, brackets, or a combination thereof). Accordingly, rotation of the lever 116 and the additional lever 140 about the axis 128 (e.g., in response to being driven by the actuator 102) causes the piston 114 to move along the axis 108. The piston 114 engages or disengages a packer 148 (e.g., elastomeric packer) as it moves along the axis 108. For example, when in the open position illustrated in FIGS. 4 and 5, the piston 114 is in a disengaged position 150, thereby not compressing the packer 148 to form the seal.

Figure 6:
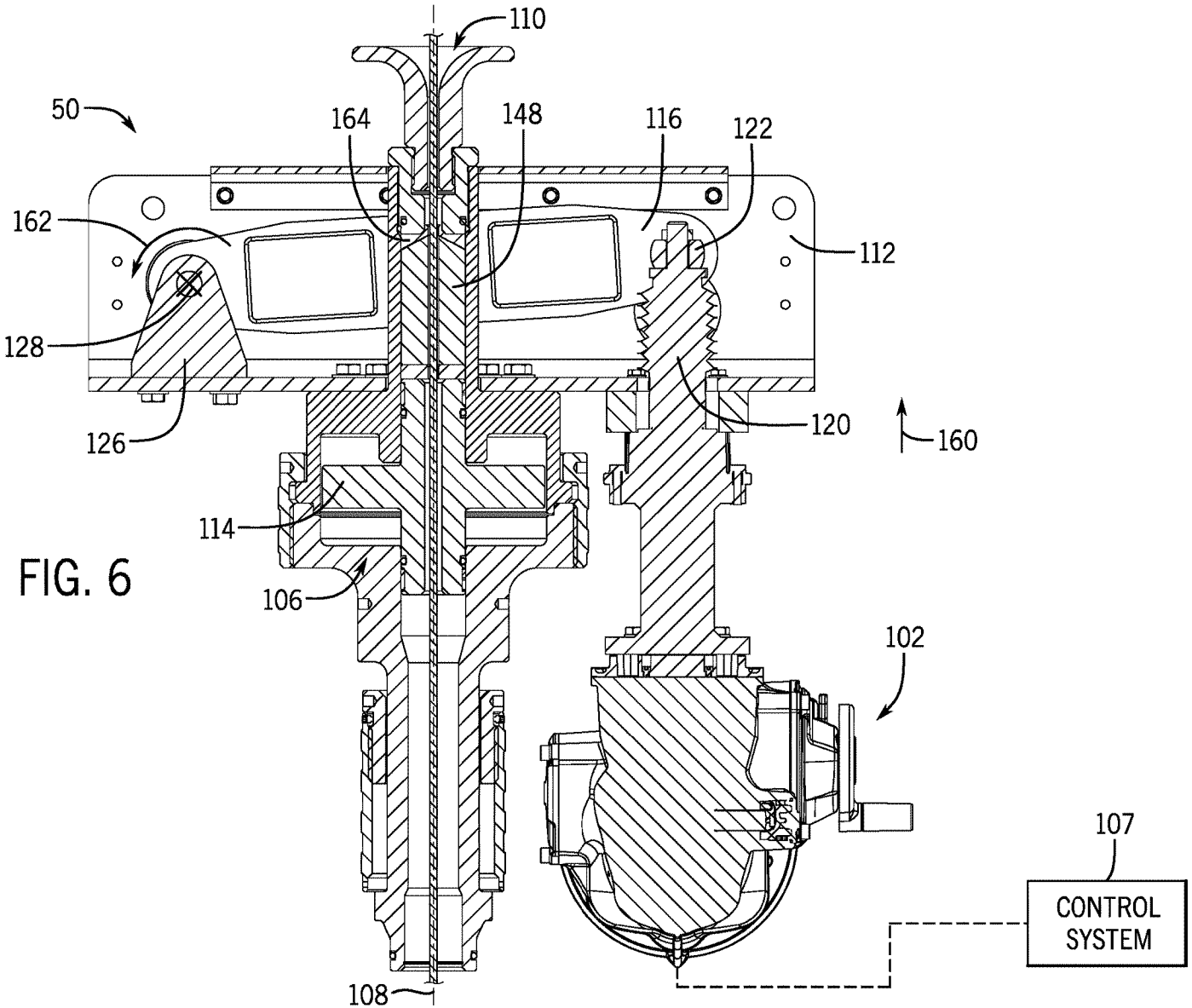
FIG. 6 is a front cross-section of an embodiment of the actuation assembly of FIG. 3 in a closed position.
Figure 7:
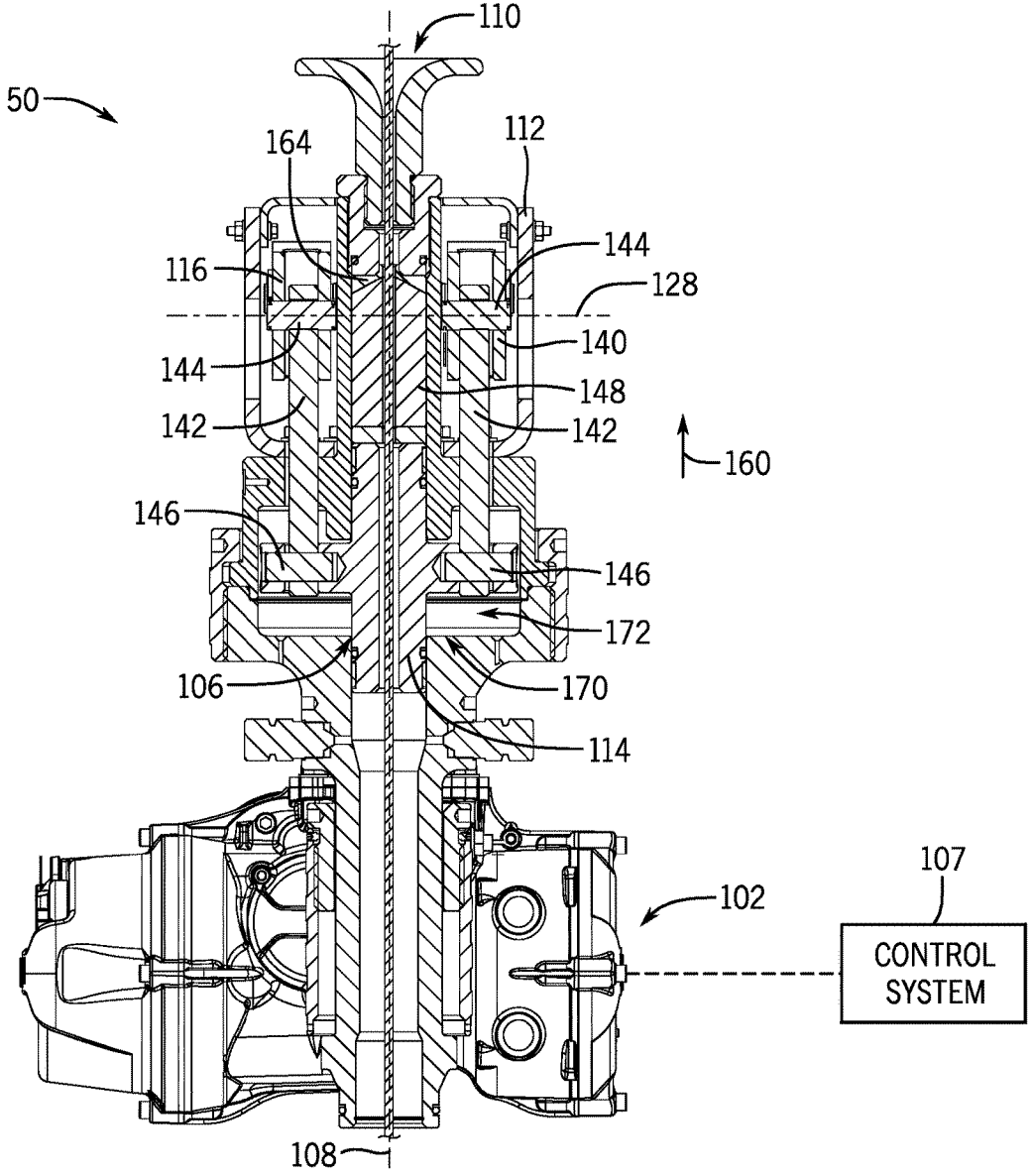
FIG. 7 is a side cross-section of an embodiment of the actuation assembly of FIG. 3 in the closed position.

To move the piston 114 into an engaged position, the actuator 102 may generate a force in a direction 160 along the axis 108, as shown in FIGS. 6 and 7. For example, FIG. 6 is a front cross-section of an embodiment of the actuation assembly 50 in a closed position (e.g., the packer 148 seals around the conduit 20) taken along line 4-4 of FIG. 3. As shown in the illustrated embodiment of FIG. 6, the actuator 102 (e.g., the rod 120 of the actuator 102) is displaced along the axis 108 in the direction 160 (e.g., as compared to FIGS. 4 and 5). Movement of the actuator 102 rotates the lever 116 (and/or the additional lever 140) at the fulcrum 126 about the axis 128 in a circumferential direction 162. Rotation of the lever 116 and/or the additional lever 140 drives the rods 142 in the direction 160, which causes the piston 114 to move in the direction 160 (see, e.g., FIG. 7). The piston 114 contacts and compresses the packer 148 (e.g., against an annular stop 164) as it moves in the direction 160 to form the seal. For example, the packer 148 may move radially inward through the passage 110 to seal around the conduit 20.

FIG. 7 is a side cross-section of the actuation assembly 50 in the closed position taken along line 5-5 of FIG. 3. The rods 142 coupled to the levers 116, 140 are directed in the direction 160 as a result of rotation of the levers 116, 140 about the axis 128. Accordingly, the rods 142 drive movement of the piston 114 in the direction 160, such that the piston 114 moves from the disengaged position 150 to an engaged position 170 within a chamber 172 of the actuation assembly 50. When in the engaged position 170, the piston 114 contacts and compresses the packer 148, such that the packer 148 is directed radially inward and around the conduit 20 to form a seal. For instance, the packer 148 may include a resilient material (e.g., elastomeric material) that surrounds the passage 110 and the conduit 20. In a natural or inactive state, the packer 148 may not protrude or otherwise be positioned within the passage 110 enabling a flow of fluid through the actuation assembly 50. When engaged by the piston 114, the packer 148 compresses and is driven radially inward toward the passage 110 and the conduit 20. The packer 148 may substantially seal or otherwise fill the passage 110 and seal against the conduit 20 when the piston 114 is in the engaged position 170 to block the flow of fluid through the actuation assembly 50. It should be appreciated that the actuator 102 may be controlled to adjust the piston 114 to any intermediate position between the open position and the closed position to adjust the seal formed by the packer 148 against the conduit 20.

Sealing the packer 148 around the conduit 20 blocks a flow of fluid through the actuation assembly 50 and/or the PCE stack 18 under certain operating conditions. For example, as set forth above, the control system 107 may send a signal to the actuator 102 to generate the force in the direction 160, which ultimately causes the piston 114 to compress the packer 148 to form the seal around the conduit 20. The control system 107 may send the signal to the actuator 102 based on feedback received from one or more sensors within the mineral extraction system 10. As a non-limiting example, the control system 107 may receive feedback indicative of a pressure in the lubricating section 34, and send the signal to the actuator 102 when the feedback exceeds a threshold. In still further embodiments, the control system 107 may receive any suitable feedback that causes the control system 107 to send the signal to the actuator 102 to form the seal about the conduit 20 to block a flow of fluid through the actuation assembly 50 and/or the PCE stack 18.

Figure 8:
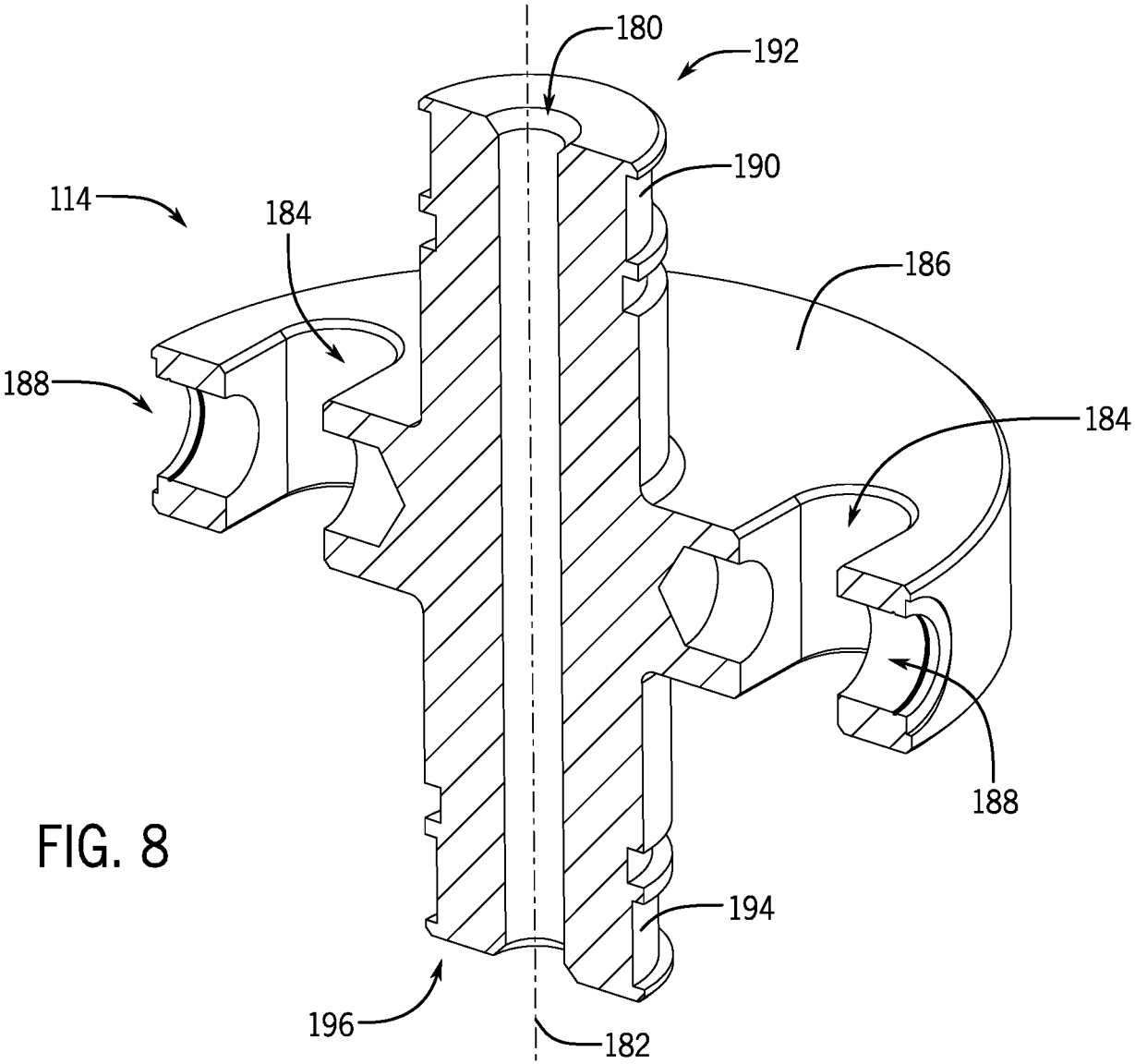
FIG. 8 is a cross-section of an embodiment of a piston for the actuation assembly of FIGS. 3-7.

FIG. 8 is a perspective cross-section of an embodiment of the piston 114 utilized in the actuation assembly 50. As shown in the illustrated embodiment of FIG. 8, the piston 114 includes a bore 180 extending along a central axis 182 of the piston 114 (e.g., the axis 182 may be co-axial with the axis 108). The bore 180 may receive the conduit 20 as well as enable a flow of fluid through the piston 114. Additionally, the piston 114 includes slots 184 disposed within a body portion 186. The slots 184 are configured to receive the rods 142 that couple the piston 114 to the levers 116, 140. Additionally, openings 188 may extend into the body portion 186 of the piston 114 and through the slots 184. The openings 188 are configured to receive the fasteners 146 that secure the rods 142 to the piston 114.

Further, the piston 114 may include seals 190 (e.g., first annular seals positioned on a top portion 192 or first end portion of the piston 114) and seals 194 (e.g., second annular seals positioned on a bottom portion 196 or second end portion of the piston 114). In some embodiments, the seals 190, 194 may be substantially the same size and shape as one another, which may facilitate manufacturing and assembly of the actuation assembly 50. Additionally, forming both seals 190, 194 with substantially the same size (e.g., respective diameters vary by less than about 10, 5, 4, 3, 2, or 1 percent) may reduce an amount of force exerted on the piston 114 by fluid within the wellhead 12, thereby blocking inadvertent movement of the piston 114 (e.g., movement of the piston 114 caused by fluid pressure instead of the actuator 102 and/or the lever assembly 104). For example, the pressure of the fluid in the wellhead 12 may be more evenly distributed throughout the piston 114 by utilizing the seals 190, 194 having substantially the same size. In some embodiments, fluid from the wellbore 12 may be positioned proximate to both the top portion 192 and the bottom portion 196 of the piston 114. Including the seals 190, 194 on both the top portion 192 and the bottom portion 196 may reduce movement of the piston 114 caused by pressure exerted on the piston 114 from either the top portion 192 and/or the bottom portion 196. Further still, the seals 190, 194 may block a flow of fluid from moving into the chamber 172 in which the piston 114 moves. As such, movement of the piston 114 within the chamber 172 may be facilitated by blocking fluid from flowing into the chamber 172.

Figure 9:
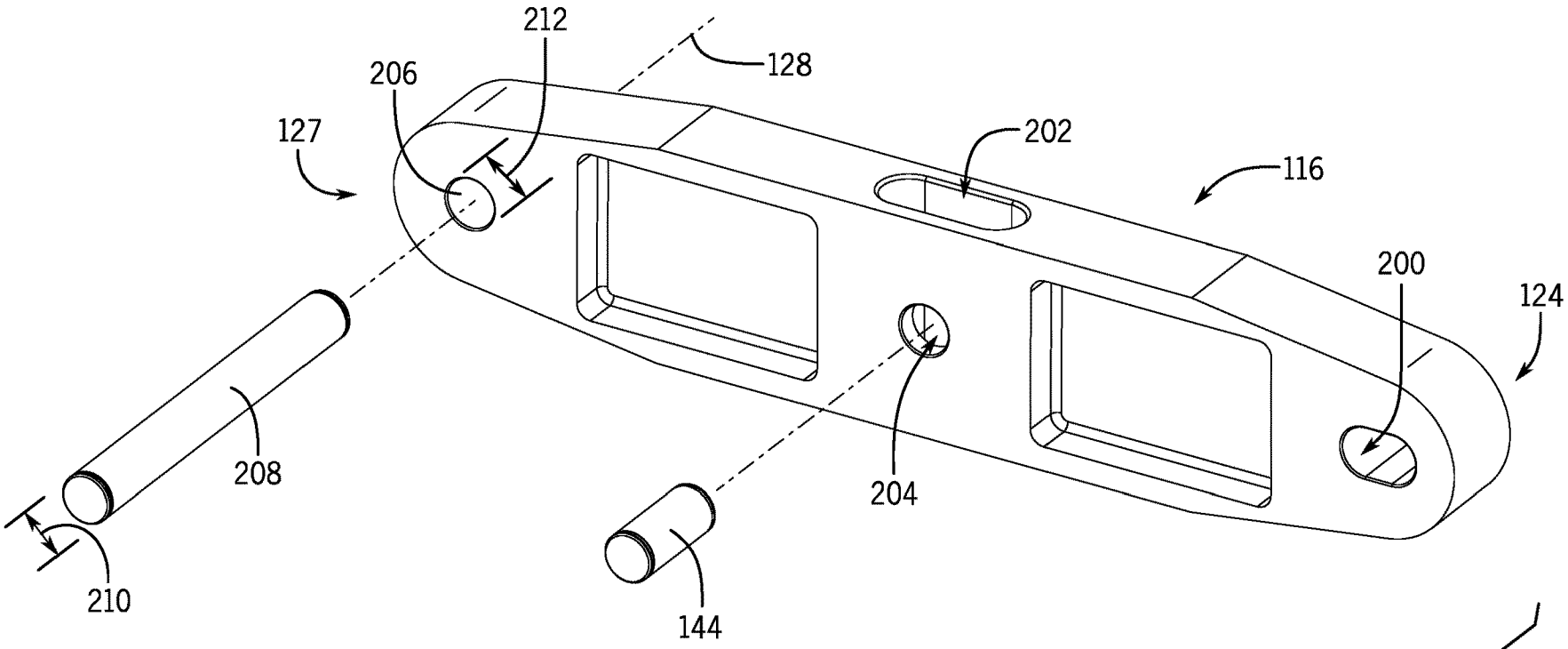
FIG. 9 is a perspective view of an embodiment of a lever for the actuation assembly of FIGS. 3-7.

As set forth above, the lever assembly 104 may include the levers 116, 140, which may rotate about the axis 128 at the fulcrum 126. Accordingly, a substantially linear force exerted on the levers, 116, 140 by the actuator 102 causes the levers 116, 140 to rotate. Because movement of the levers 116, 140 is not linear, the actuator 102 may be coupled to the levers 116, 140 via a slot of the levers 116, 140. For example, FIG. 9 is a perspective view of an embodiment of the lever 116 having a slot 200 (e.g., oblong slot) configured to couple the lever 116 to the actuator 102 at the first end 124 of the lever assembly 104. The interface 118 between the lever 116 and the actuator 102 may include the rod 120 and the fastener 122 (e.g., a coupler having a nut and/or a bar having a nut). As such, the fastener 122 may slide within the slot 200 (e.g., toward and away from an opening 202 [e.g., a first opening]) to enable the lever 116 to rotate as the substantially linear force is applied by the actuator 102.

As shown in the illustrated embodiment of FIG. 9, the lever 116 includes the opening 202 that is configured to receive and enable a connection to one of the rods 142. For example, the opening 202 may receive the rod 142 and one fastener 144 may be inserted into an opening 204 (e.g., a second opening) to secure the rod 142 to the lever 116. In some embodiments, the rod 142 may be integral with the lever 116 (e.g., welded to or formed as a single, unitary piece), such that the openings 202, 204 are not included in the lever 116.

Further still, the lever 116 may include an opening 206 (e.g., a third opening) configured to secure the lever 116 to the fulcrum 126 at the second end 127 of the lever assembly 104. A fastener 208 may be disposed within the opening 206 and enable the lever 116 to rotate with respect to the fulcrum 126. Thus, the fastener 208 may include a diameter 210 that is less than a diameter 212 of the opening 206 to enable rotation of the lever 116 about the fulcrum 126. In other embodiments, the lever 116 may be coupled to the fulcrum 126 utilizing another suitable technique that enables rotation of the lever 116 about the axis 128.

Figure 10:
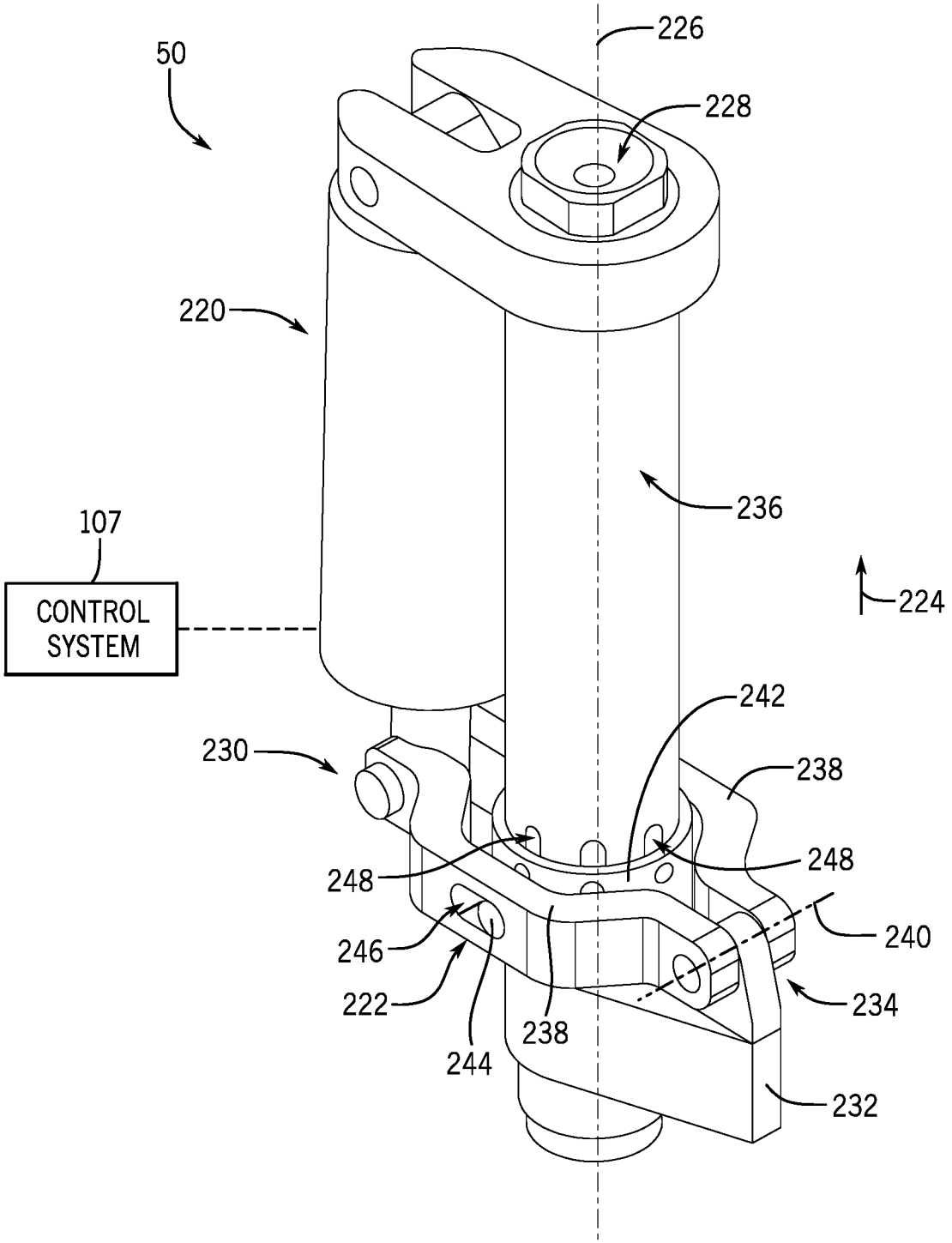
FIG. 10 is a perspective view of an embodiment of the actuation assembly for a component of the PCE stack.

FIG. 10 is a perspective view of another embodiment of the actuation assembly 50. As shown in the illustrated embodiment of FIG. 10, the actuation assembly 50 includes an actuator 220 and a lever assembly 222. The actuator 220 may be substantially the same as the actuator 102 (e.g., an electric, linear actuator) that directs a force in a direction 224 along an axis 226 (e.g., central axis) defining a passage 228 along which the conduit 20 extends. The force from the actuator 220 is transferred to the lever assembly 222, which is coupled to the actuator 220 at a first end 230 of the lever assembly 222 and to a fulcrum 232 at a second end 234 of the lever assembly 222. The fulcrum 232 may be substantially stationary with respect to a body portion 236 of the actuation assembly 50. Accordingly, levers 238 of the lever assembly 222 rotate about an axis 240 extending through the fulcrum 236 as the actuator 220 exerts the force in the direction 224.

Additionally, the levers 238 of the lever assembly 222 may be coupled to a ring member 242 that is positioned between the first end 230 and the second end 234 of the lever assembly 222. The ring member 242 may include protrusions 244 that are disposed within respective openings 246 of the levers 238 of the lever assembly 222. The ring member 242 is driven in the direction 224 as the levers 238 of the lever assembly 222 rotate about the axis 240. As shown in the illustrated embodiment of FIG. 10, the body portion 236 of the actuation assembly 50 includes slots 248 (e.g., oblong slots) that enable the ring member 242 to move along the axis 226 in the direction 224. For example, the ring member 242 may also be coupled to a piston via pins (see, e.g., FIGS. 11 and 12). Accordingly, the slots 248 may receive the pins that extend through the body portion 236 and couple to the piston, while enabling movement of the pins in the direction 224 with the ring member 242.

Figure 11:
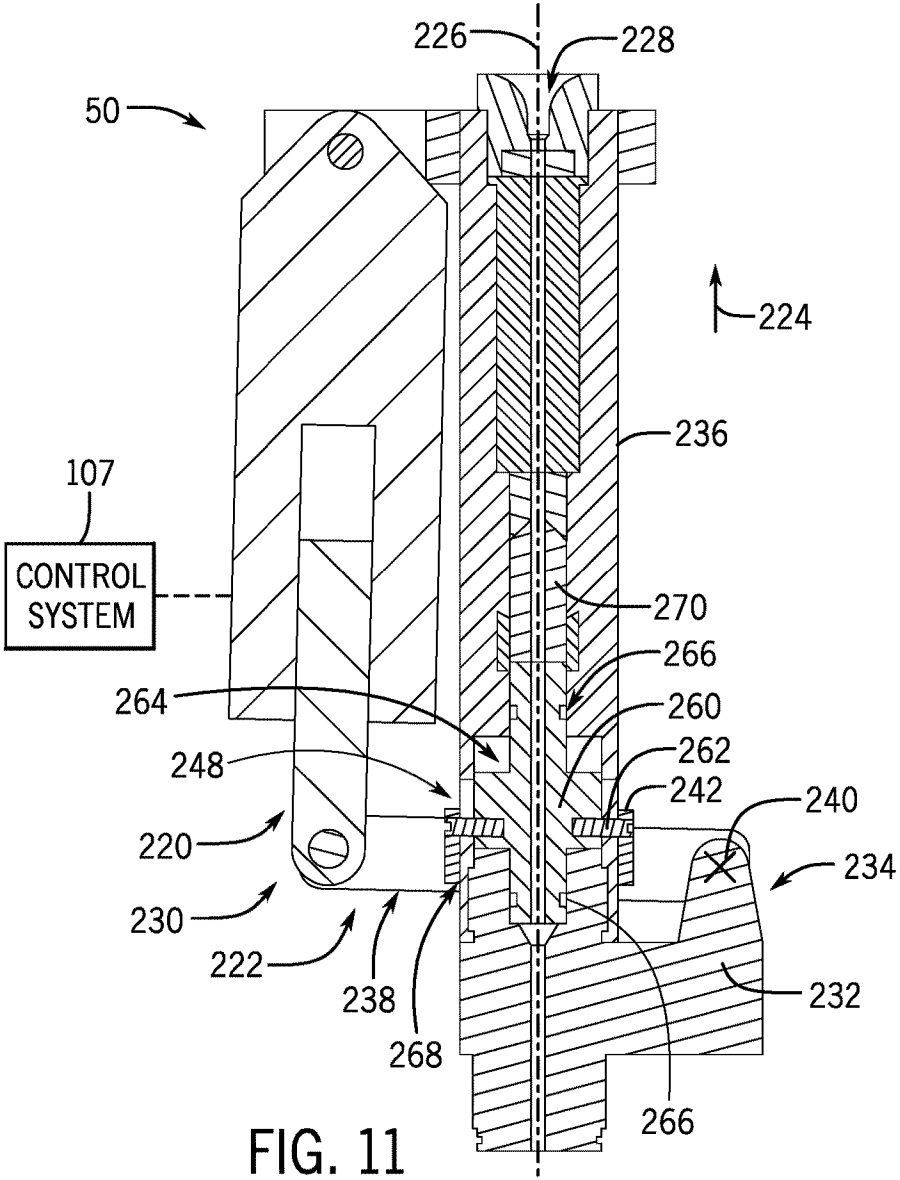
FIG. 11 is a front cross-section of an embodiment of the actuation assembly of FIG. 10 in an open position.

FIG. 11 is a front cross-section of the actuation assembly 50 of FIG. 10 in an open position (e.g., a packer is not sealed about the conduit 20). As shown in the illustrated embodiment of FIG. 11, the ring member 242 is coupled to a piston 260 (e.g., annular piston) via pins 262 extending through the slots 248 in the body portion 236. The pins 262 are driven to move along the slots 248 as the ring member 242 moves along the axis 226. Additionally, the pins 262 drive movement of the piston 260 along the axis 226 within a chamber 264 of the body portion 236. The piston 260 includes seals 266 that are configured to block fluid from flowing into the chamber 264 of the body portion 236. The seals 266 may be substantially the same size as one another, similar to the embodiment of the piston 114 shown in FIG. 8. The piston 260 is in an unengaged position 268, such that the actuation assembly 50 is in the open position. In other words, fluid may flow around the conduit 20 through the passage 228 when the piston 260 is in the unengaged position 268 because a packer 270 (e.g., elastomeric annular packer) is not sealed around the conduit 20.

Figure 12:
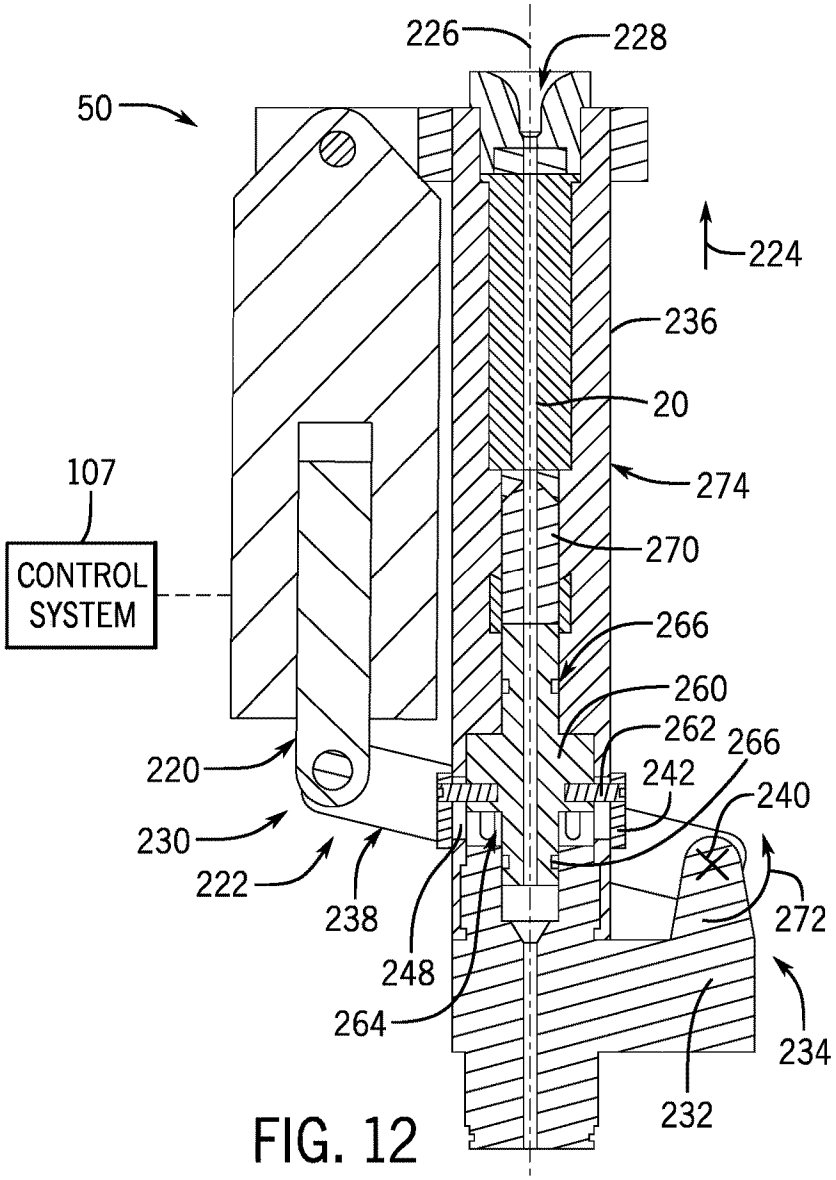
FIG. 12 is a front cross-section of an embodiment of the actuation assembly of FIG. 10 in a closed position.

FIG. 12 is a front cross-section of the actuation assembly of FIGS. 10 and 11 in a closed position (e.g., the packer 270 is sealed around the conduit 20). As shown in the illustrated embodiment of FIG. 12, the actuator 220 generates a force in the direction 224. Accordingly, the levers 238 are directed in a circumferential direction 272 about the axis 240 as a result of the force applied to the levers 238 by the actuator 220. Rotation of the levers 238 about the axis 240 causes the ring member 242 to move in the direction 224 along an outer surface 274 of the body portion 236. Additionally, the pins 262 move in the direction 224 within the slots 248 and drive movement of the piston 260 in the direction 224 toward the packer 270. The piston 260 compresses the packer 270, such that a portion of the packer 270 is directed radially inward toward the conduit 20 and into the passage 228. Thus, the packer 270 may block a flow of fluid through the actuation assembly 50 by filling the passage 228 and forming a seal around the conduit 20. It should be appreciated that the actuator 220 may be controlled to adjust the piston 260 to any intermediate position between the open position and the closed position to adjust the seal formed by the packer 270 against the conduit 20.

Figure 13:
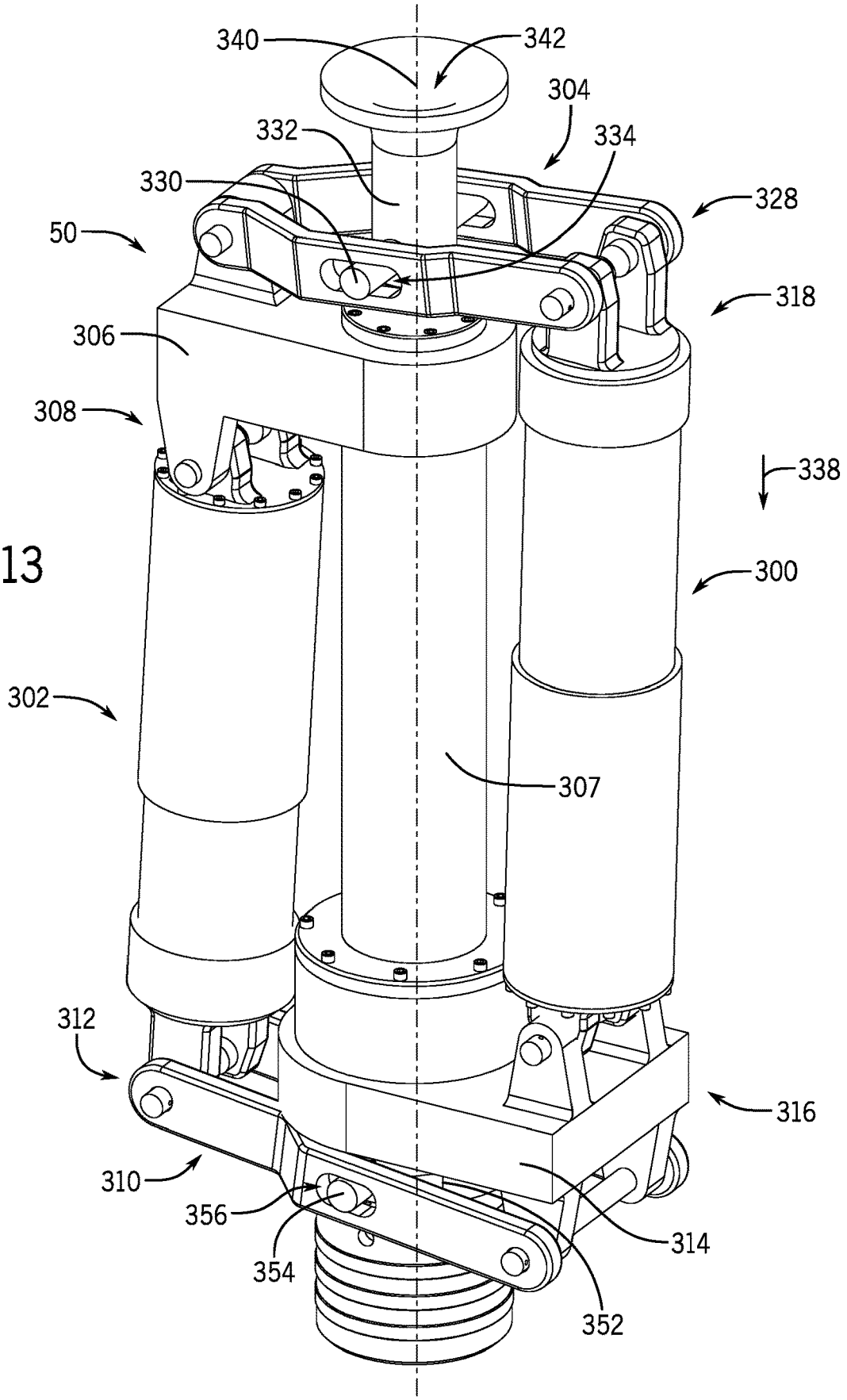
FIG. 13 is a perspective view of an embodiment of the actuation assembly for a component of the PCE stack.

FIG. 13 is a perspective view of another embodiment of the actuation assembly 50. In the illustrated embodiment of FIG. 13, the actuation assembly 50 includes an actuator 300 (e.g., a first actuator) and an actuator 302 (e.g., a second actuator). In some embodiments, the actuator 300 may be utilized for sealing the stuffing box 30 and the actuator 302 may be utilized for actuating or adjusting a position of another component of the PCE stack 18 (e.g., the tool catcher 32 and/or the tool trap 36). As such, the actuators 300, 302 may operate independently of one another to control respective components of the PCE stack 18.

As shown in the illustrated embodiment of FIG. 13, the actuator 300 may be configured to seal the stuffing box 30 (e.g., to cause the packer 148 and/or the packer 270 to seal around the conduit 20). For example, the actuator 300 may be coupled to a lever assembly 304 that is configured to rotate about a fulcrum 306. As shown in the illustrated embodiment of FIG. 13, the fulcrum 306 may also act as a base for the actuator 302 (e.g., the fulcrum 306 is substantially stationary with respect to a body 307 of the actuation assembly 50). Accordingly, the actuator 302 may be coupled to and/or suspended from the fulcrum 306 at a first end 308 of the actuator 302 and coupled to an additional lever assembly 310 (e.g., a second lever assembly) at a second end 312 of the actuator 302. Similarly, the actuator 300 may be coupled to an additional fulcrum 314, about which the additional lever assembly 310 is configured to rotate. The actuator 300 is coupled to the additional fulcrum 314 at a third end 316 of the actuator 300 and coupled to the lever assembly 304 at a fourth end 318 of the actuator 300. As such, the additional fulcrum 314 may act as a base for the actuator 300 (e.g., the additional fulcrum 314 is substantially stationary with respect to the body 307 of the actuation assembly 50).

As set forth above, the actuator 300 may be configured to control the stuffing box 30. As shown in the illustrated embodiment of FIG. 13, the actuator 300 is coupled to the lever assembly 304 (e.g., via a bolt, a screw, a rivet, or another suitable fastener) at a first end 328 of the lever assembly 304. The lever assembly 304 is coupled to protrusions 330 of a ring member 332 via slots 334 (e.g., oblong slots) of the lever assembly 304. The ring member 332 is further coupled to a piston 336 (e.g., annular piston, as shown in FIG. 14) configured to be driven in a direction 338 along an axis 340 (e.g., central axis) defining a passage 342 through the body 307 of the actuation assembly 50.

Figure 14:
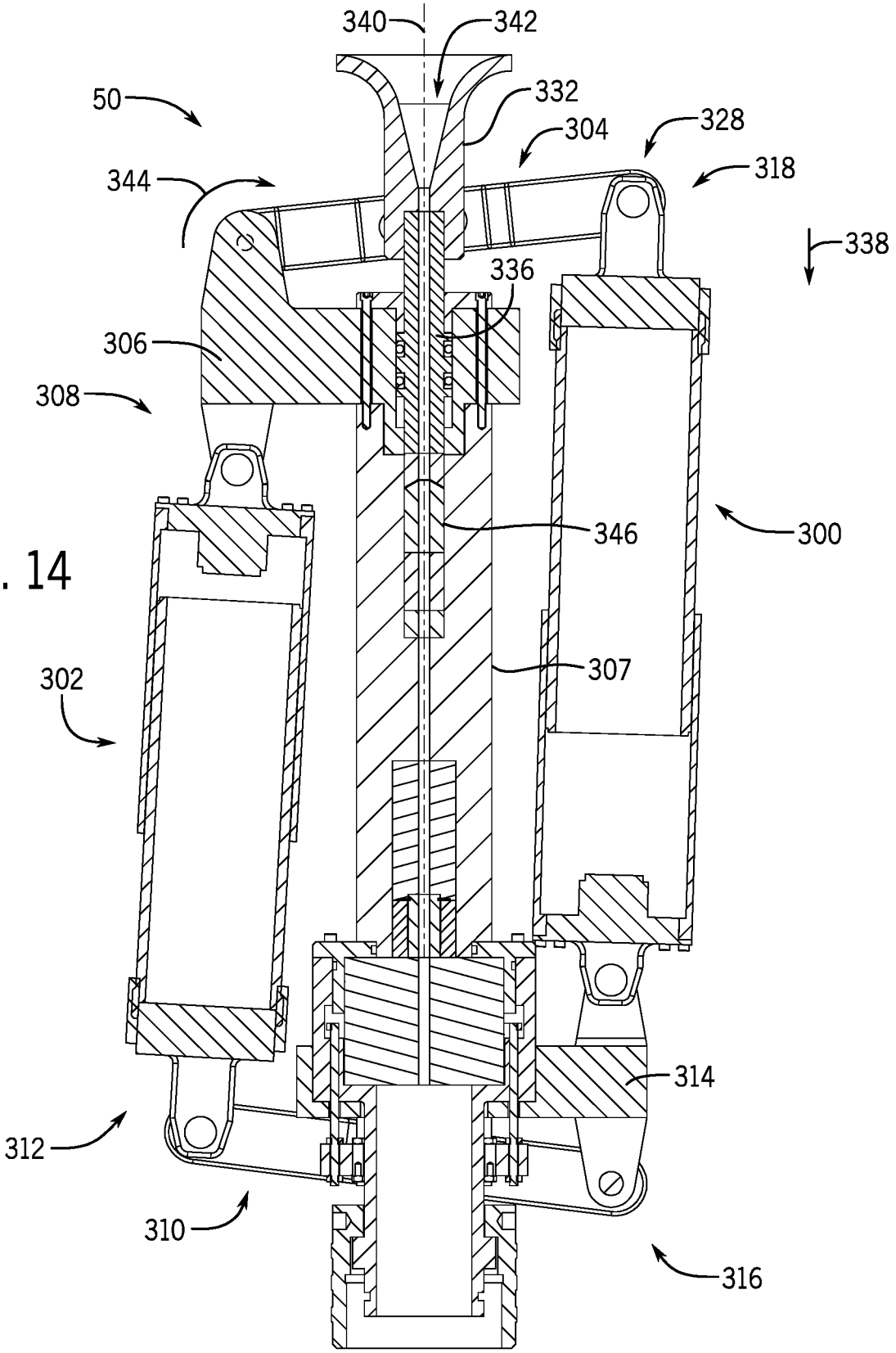
FIG. 14 is a front cross-section of an embodiment of the actuation assembly of FIG. 13 in an open position.

For example, FIG. 14 is a front cross-section of an embodiment of the actuation assembly 50 in an open position (e.g., a packer of the stuffing box 30 is not sealed around the conduit 20). In some embodiments, the actuator 300 is driven in the direction 338 along the axis 340, thereby generating a force in the direction 338. The force causes rotation of the lever assembly 304 about the fulcrum 306 in a circumferential direction 344. Rotation of the lever assembly 304 directs the ring member 332 in the direction 338 along the axis 340. Further still, the ring member 332 directs the piston 336 in the direction 338 along the axis 340 toward a packer 346 (e.g., elastomeric annular packer) of the stuffing box 30. The piston 336 may contact the packer 346 and compress the packer 346 to drive the packer 346 radially inward toward the passage 342, such that the packer 346 contacts and seals around the conduit 20 disposed within the passage 342. As such, movement of the actuator 300 in the direction 338 ultimately causes the packer 346 of the stuffing box 30 to seal around the conduit 20 and block a flow of fluid through the passage 342.

Figure 15:
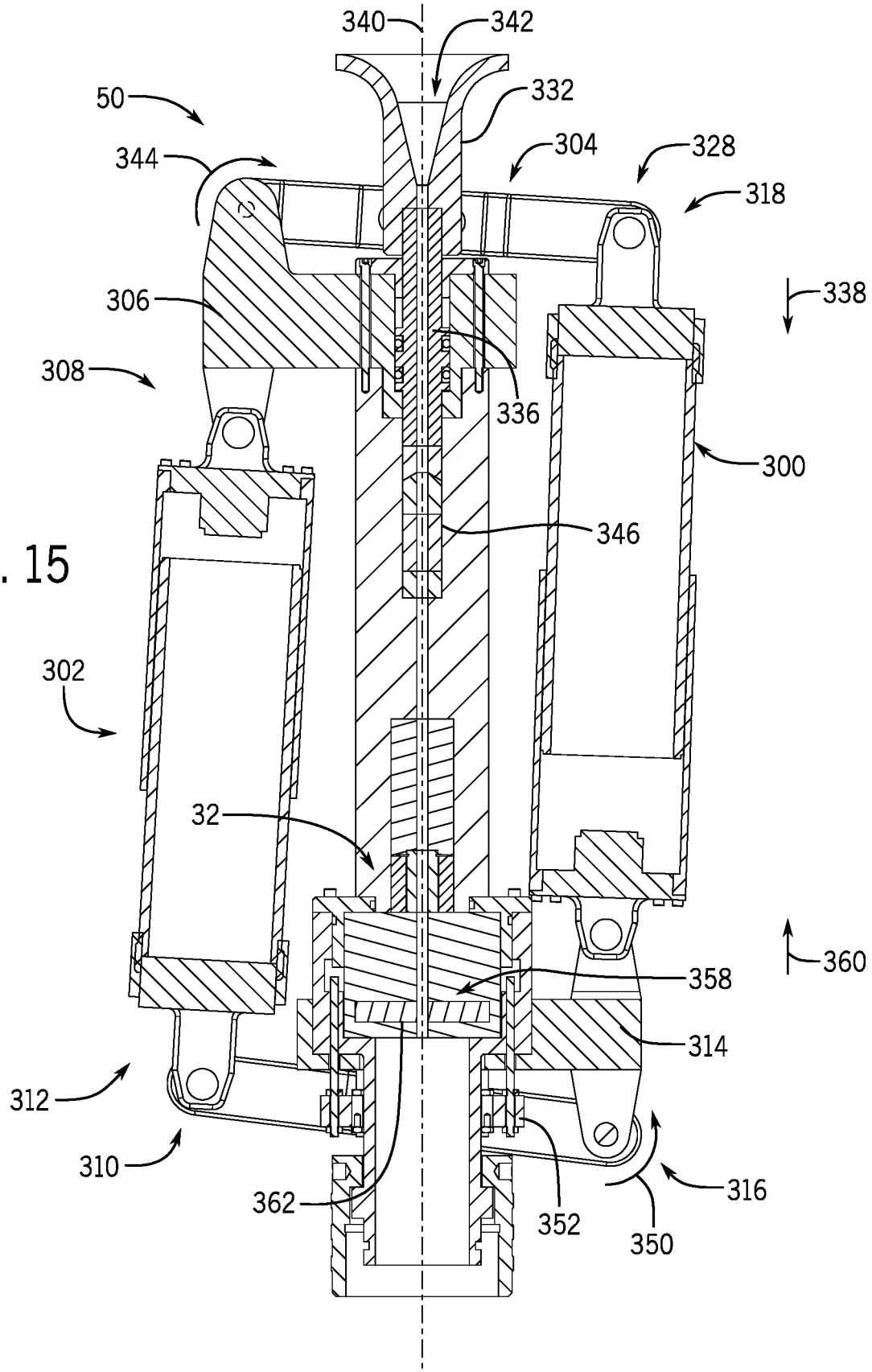
FIG. 15 is a front cross-section of an embodiment of the actuation assembly of FIG. 13 in a closed position.

For instance, FIG. 15 is a front cross-section of an embodiment of the actuation assembly 50 of FIG. 14 in a closed position (e.g., the packer 346 is sealed around the conduit 20). As shown in the illustrated embodiment, the piston 336 has moved in the direction 338 along the axis 340 when compared to the embodiment shown in FIG. 14. As such, the piston 336 is in contact with the packer 346 and has compressed the packer 346 to drive the packer 346 radially inward toward the conduit 20. It should be appreciated that the actuator 300 may be controlled to adjust the piston 336 to any intermediate position between the open position and the closed position to adjust the seal formed by the packer 346 against the conduit 20.

As set forth above, the actuator 302 may be configured to actuate or control another component of the PCE stack 18 in addition to, or in lieu of, the stuffing box 30. As shown in the illustrated embodiment of FIGS. 13-15, the actuator 302 is configured to adjust a position of the tool catcher 32. For example, the actuator 302 is coupled to the additional lever assembly 310 and is configured to rotate the additional lever assembly 310 about the additional fulcrum 314 in a circumferential direction 350. In some embodiments, the additional lever assembly 310 is coupled to an additional ring member 352 (e.g., a second ring member). For example, a protrusion 354 of the additional ring member 352 may extend into slots 356 (e.g., oblong slots) of the additional lever assembly 310 (see, e.g., FIG. 13). Rotation of the additional lever assembly 310 in the circumferential direction 350 may direct a piston assembly 358 of the tool catcher 32 in a direction 360, opposite the direction 338, along the axis 340. The piston assembly 358 may drive tool catching components 362 radially inward (e.g., toward the conduit 20 and/or otherwise into the passage 342) to block a tool from moving through the passage 342. In some embodiments, the actuators 300, 302 may be controlled or adjusted independently of one another, such that the stuffing box 30 and the tool catcher 32 may operate independently of one another.

It should be noted that while the illustrated embodiment of FIGS. 13-15 show the actuator 302 as controlling the tool catcher 32, in other embodiments, the actuator 302 (and/or the actuation assembly 50) may be utilized to control or otherwise adjust a position of any other suitable component of the PCE stack 18.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. An actuation assembly to actuate a component of a mineral extraction system, the actuation assembly comprising:

an actuator configured to generate a force in a direction;

a lever assembly coupled to the actuator, wherein the lever assembly is configured to rotate about a fulcrum in response to application of the force and is coupled to the actuator at a first end of the lever assembly, the lever assembly is coupled to the fulcrum at a second end of the lever assembly, opposite the first end, and the lever assembly is coupled to the piston between the first end and the second end; and a piston coupled to the lever assembly, wherein the piston is configured to move in the direction in response to rotation of the lever assembly about the fulcrum.

2. The actuation assembly of claim 1, wherein the lever assembly is coupled to the piston at a substantially equal distance between the first end and the second end.

3. The actuation assembly of claim 1, wherein the lever assembly is coupled to the piston via one or more rods.

4. The actuation assembly of claim 1, wherein the actuator is coupled to the lever assembly at the first end of the lever assembly via a slot extending through the lever assembly.

5. The actuation assembly of claim 1, comprising a body and a passage extending through the body, wherein the piston is disposed within the body.

6. The actuation assembly of claim 5, comprising a packer disposed within the body, wherein the piston is configured to move in the direction to drive the packer radially inward toward a conduit to form a seal within the passage.

7. The actuation assembly of claim 1, wherein the piston comprises a first seal at a first end of the piston and a second seal at a second end of the piston, and wherein the first seal and the second seal have substantially equal diameters.

8. The actuation assembly of claim 1, wherein the actuator comprises an electric, linear actuator.

9. The actuation assembly of claim 1, wherein the lever assembly comprises a pair of balanced levers.

10. The actuation assembly of claim 1, wherein the component of the mineral extraction system comprises a stuffing box, a tool catcher, or a tool trap.

11. A stuffing box for a pressure control equipment (PCE) stack, comprising:

an actuator configured to generate a force in a direction;

a lever assembly coupled to the actuator, wherein the lever assembly is configured to rotate about a fulcrum in response to application of the force and is coupled to the actuator at a first end of the lever assembly, the lever assembly is coupled to the fulcrum at a second end of the lever assembly, opposite the first end, and the lever assembly is coupled to the piston between the first end and the second end;

a body comprising a passage extending through the body;

a piston disposed within the body, wherein the piston is coupled to the lever assembly and is configured to move in the direction in response to rotation of the lever assembly about the fulcrum; and a packer disposed coaxially to the piston within the body, wherein the movement of the piston in the direction is configured to compress the packer to drive the packer radially inward toward a conduit disposed within the passage.

12. The stuffing box of claim 11, wherein the piston comprises a first seal at a first end of the piston and a second seal at a second end of the piston, and wherein the first seal and the second seal have substantially equal diameters.

13. The stuffing box of claim 11, wherein the lever assembly comprises a pair of balanced levers.

14. The stuffing box of claim 11, wherein a lever of the lever assembly is coupled to the actuator via a slot extending through the lever assembly.

15. The stuffing box of claim 14, wherein a fastener coupling the actuator to the lever of the lever assembly is configured to slide within the slot to enable the lever to receive application of the force in the direction and to rotate about the fulcrum in a circumferential direction.

16. A mineral extraction system, comprising:

a wellhead configured to couple to a mineral deposit via a wellbore;

a controller configured to receive feedback indicative of a pressure in the wellbore, wherein the controller is configured to send a signal to the actuator based on the feedback; and a pressure control equipment (PCE) stack coupled to the wellhead, wherein the PCE stack comprises:

a stuffing box, comprising:

an actuator configured to generate a force in a direction;

a lever assembly coupled to the actuator, wherein the lever assembly is configured to rotate about a fulcrum in response to application of the force; and a piston coupled to the lever assembly, wherein the piston is configured to move in the direction in response to rotation of the lever assembly about the fulcrum.

17. The mineral extraction system of claim 16, wherein the controller is configured to control the actuator in response to the feedback exceeding a threshold pressure.

* * * * *